United States Patent [19]

Childers et al.

[11] Patent Number: 4,516,642

[45] Date of Patent: May 14, 1985

[54] DRILL BIT HAVING ANGLED NOZZLES FOR IMPROVED BIT AND WELL BORE CLEANING

[75] Inventors: John S. Childers, Greenville; Paul E. Pastusek, Houston, both of Tex.

[73] Assignee: Reed Rock Bit Company, Houston, Tex.

[21] Appl. No.: 437,927

[22] Filed: Nov. 1, 1982

Related U.S. Application Data

[63] Continuation-in-part of Ser. No. 132,950, Mar. 24, 1980, abandoned.

[51] Int. Cl.[3] ..... E21B 10/18

[52] U.S. Cl. ..... 175/340

[58] Field of Search ..... 175/340, 339, 67

[56] References Cited

U.S. PATENT DOCUMENTS

| | | | |
|---|---|---|---|
| 1,922,436 | 8/1933 | Herrington | 175/340 |
| 2,098,758 | 11/1937 | Reed | 175/340 |
| 2,244,617 | 6/1941 | Hannum | 175/340 |
| 2,815,936 | 12/1957 | Peter et al. | 175/340 |
| 3,984,158 | 10/1976 | Sorensen et al. | 308/8.2 |
| 4,106,577 | 8/1978 | Summers | 175/340 |
| 4,187,920 | 2/1980 | Johnson | 175/340 X |
| 4,222,447 | 9/1980 | Cholet | 175/340 |
| 4,239,087 | 12/1980 | Castel et al. | 175/340 |

FOREIGN PATENT DOCUMENTS

| | | | |
|---|---|---|---|
| 1104310 | 2/1968 | United Kingdom | 175/340 |

*Primary Examiner*—James A. Leppink
*Assistant Examiner*—Hoang C. Dang
*Attorney, Agent, or Firm*—Carl A. Rowold

[57] ABSTRACT

A rotary drill bit comprising a bit body having a chamber therein adapted to receive drilling fluid under pressure, a plurality of nozzles in communication with the chamber for exit of the drilling fluid, and a plurality of depending legs at its lower end, each having a bearing journal. The bit further includes a plurality of roller cutters, one for each leg, each cutter comprising a generally conical cutter body rotatably mounted on the bearing journal of the respective leg, and a plurality of cutting elements thereon. Each nozzle has an orifice in a position below the top of an adjacent roller cutter but above the central axis of the respective bearing journal at its inner end with respect to the bit body. In addition, each nozzle directs the fluid to flow in the direction opposite the direction of rotation of the bit, with the flow being generally tangent to the cutter body of the adjacent roller cutter, and thereafter impinging portions of the bottom of the well bore immediately forward of the adjacent roller cutter, whereby the drilling fluid cleans these portions of the well bore bottom and the cutting elements immediately prior to their engagement for enhanced drill bit cutting action.

14 Claims, 5 Drawing Figures

DRILL BIT HAVING ANGLED NOZZLES FOR IMPROVED BIT AND WELL BORE CLEANING

CROSS-REFERENCE TO OTHER APPLICATIONS

This is a continuation-in-part of U.S. patent application Ser. No. 132,950, filed Mar. 24, 1980, for Rolling Cutter Drill Bit now abandoned.

BACKGROUND OF THE INVENTION

This invention relates to rotary drill bits for drilling oil wells and the like, and more particularly to rotary dill bits used in conjunction with drilling fluid circulation systems of a rotary drill rig.

This invention involves an improvement over the rotary drill bit of the type, such as that shown, for example, in U.S. Pat. Nos. 3,984,158 and 4,106,577, British Pat. No. 1,104,310 and FIG. 5 of this application, comprising a bit body having an upper portion adapted to be detachably secured to drill pipe or the like for rotating the bit, a chamber therein receiving drilling fluid under pressure from the drill pipe, and three depending legs each having an inwardly extending bearing journal. The bit further includes a roller cutter rotatably mounted on each bearing journal and three nozzles extending down between sets of adjacent roller cuttes. The drill bit is used in conjunction with the drilling fluid circulation system of a drill rig, with the drilling fluid being pumped down through the passage in the drill pipe to the chamber in the drill bit, exiting the drill bit via the nozzles, and flowing back up to the surface in the annulus around the drill pipe. The nozzles direct the drilling fluid as a high velocity stream against the bottom of the well bore to clean it, with the splashback of the drilling fluid from the bottom of the well bore impinging the roller cutters to provide limited cleaning action of the cutters. Drilling debris and cuttings from the bottom of the well bore are entrained in and are carried away from the bottom by the drilling fluid as it flows up the annulus.

While the above-described conventional drill bits have been satisfactory for drilling relatively brittle formations, they do not provide satisfactory rates of penetration when drilling relatively plastically deformable formations. Many commonly encountered formations such as salts, shales, limestones, sandstones and chalks, become plastically deformable under so-called differential pressure conditions, when the hydrostatic pressure of the column of drill fluid bearing on the bottom of the well bore exceeds the pressure of the formation surrounding the bore, as often occurs in deep hole drilling. Whereas, brittle formations by the cutting elements of a drill bit, these plastic formations tend to deform and thus remain intact under such loads. In addition, certain of these plastic formations tend to form a relatively thick coating of drilling debris on the roller cutter which can result in so-called "bit-balling" and limited penetration of the formation by the cutting elements.

As shown in U.S. Pat. No. 4,106,577 and British Pat. No. 1,104,310, attempts have been made to increase the rate of penetration in plastic foundations by using extended nozzles for improving the cleaning action of the hydraulic system. While this nozzle arrangement may offer some measure of improved cleaning action, this action is still not satisfactory for many types of plastic formations. Moreover, in this arrangement, the nozzles extend down to points closely adjacent to the bottom of the well bore, and thus are subject to damage by irregularities, such as projections or ridges, on the bottom of the well bore, which may form from time to time during drilling operations.

SUMMARY OF THE INVENTION

Among the several objects of this invention may be noted the provision of a rotary drill bit having improved hydraulic cleaning action and increased rates of drilling penetration in relatively plastically deformable formations; the provision of such a drill bit which cleans the cutting elements on the roller cutters immediately prior their moving into engagement with the bottom of the well bore; the provision of such a drill bit which cleans portions of the bottom of the well bore immediately prior to their engagement by the cutting elements so as to expose virgin formation to the cutting elements; and the provision of such a drill bit having nozzles spaced well above the bottom of the bit so as to prevent breakage of the nozzles.

In general, the drill bit of this invention comprises a bit body having a threaded pin at its upper end adapted to be detachably secured to drill pipe or the like for rotating the bit, a chamber therein adapted to receive drilling fluid under pressure from the drill pipe, a plurality of depending legs at its lower end, each leg being spaced from the other legs and having an inwardly extending, generally cylindrical bearing journal at its lower end, and a plurality of nozzles in flow communication with the chamber for exit of the drilling fluid from the bit body. A plurality of roller cutters are rotatably mounted on the bearing journals, one roller cutter for each bearing journal, each roller cutter comprising a generally conical cutter body and a plurality of cutting elements on the body. Each of said nozzles has a nozzle orifice below the top of an adjacent roller cutter but above the central axis of the respective bearing journal at its inner end with respect to the bit body. In addition, each nozzle directs the drilling fluid downwardly and in the direction opposite to the direction of rotation of the bit. The drilling fluid flows in a stream generally tangent to the cutter body of the adjacent roller cutter and thereafter impinges portions of the bottom of the well bore closely adjacent to, but spaced apart from the points of engagement of the cutting elements of the adjacent roller cutter with the bottom of the bore, whereby the drilling fluid engages and cleans at least some of the cutting elements and said portions of the well bore bottom immediately prior to the engagement of said portions of the well bore bottom by the cutting elements for enhanced drill bit cutting action.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
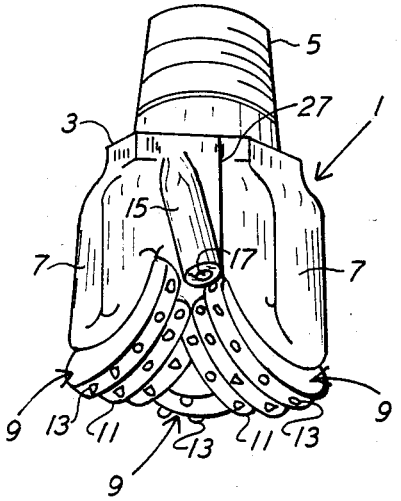
FIG. 1 is a side elevation of a first embodiment of a drill bit of this invention.

Referring to FIG. 1, there is indicated at 1, a first embodiment of a drill bit of this invention used in conjunction with the drilling fluid circulation system of a rotary drill rig (not shown) for drilling well bores in the earth. The bit comprises a bit body 3 having, at its upper end, a threaded pin 5 adapted to be threaded in drill pipe or a drill stem, which serves to rotate the bit, and a chamber therein (not shown) for receiving drilling fluid under pressure from the passage in the drill pipe. At its lower end, the bit body has three depending legs 7, each leg being spaced from the others and having an inwardly and downwardly extending, generally cylindrical bearing journal at its lower end. Three roller cutters 9 are rotatably mounted on the bearing journals, each roller cutter 9 comprising a generally conical cutter body 11 having a recess therein receiving the respective bearing journal and a plurality of cutting elements 13 on the body. The cutting elements are arranged in annular rows around the cutter body and, as shown, comprise so-called "inserts" of a hard metallic material, such as tungsten carbide. The inserts are relatively elongate members and are so mounted on the cutter body that a portion thereof projects outwardly from the cutter body. The projecting portions of the inserts are adapted to bear on the bottom 14 of the well bore.

Figure 2:
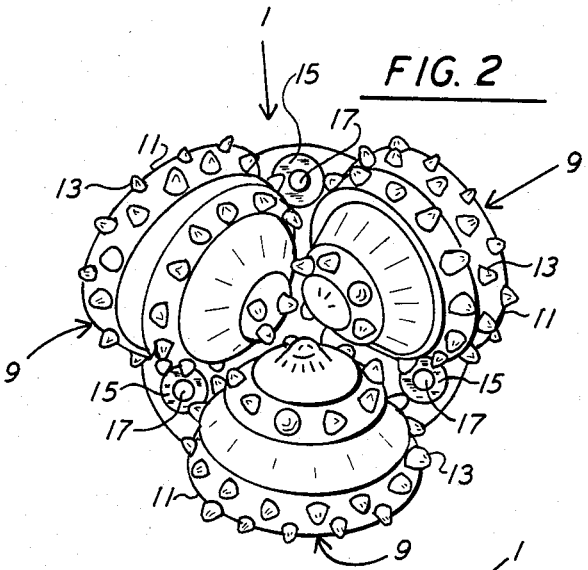
FIG. 2 is a bottom plan of FIG. 1 showing nozzles between adjacent roller cutters of the drill bit.
Figure 3:
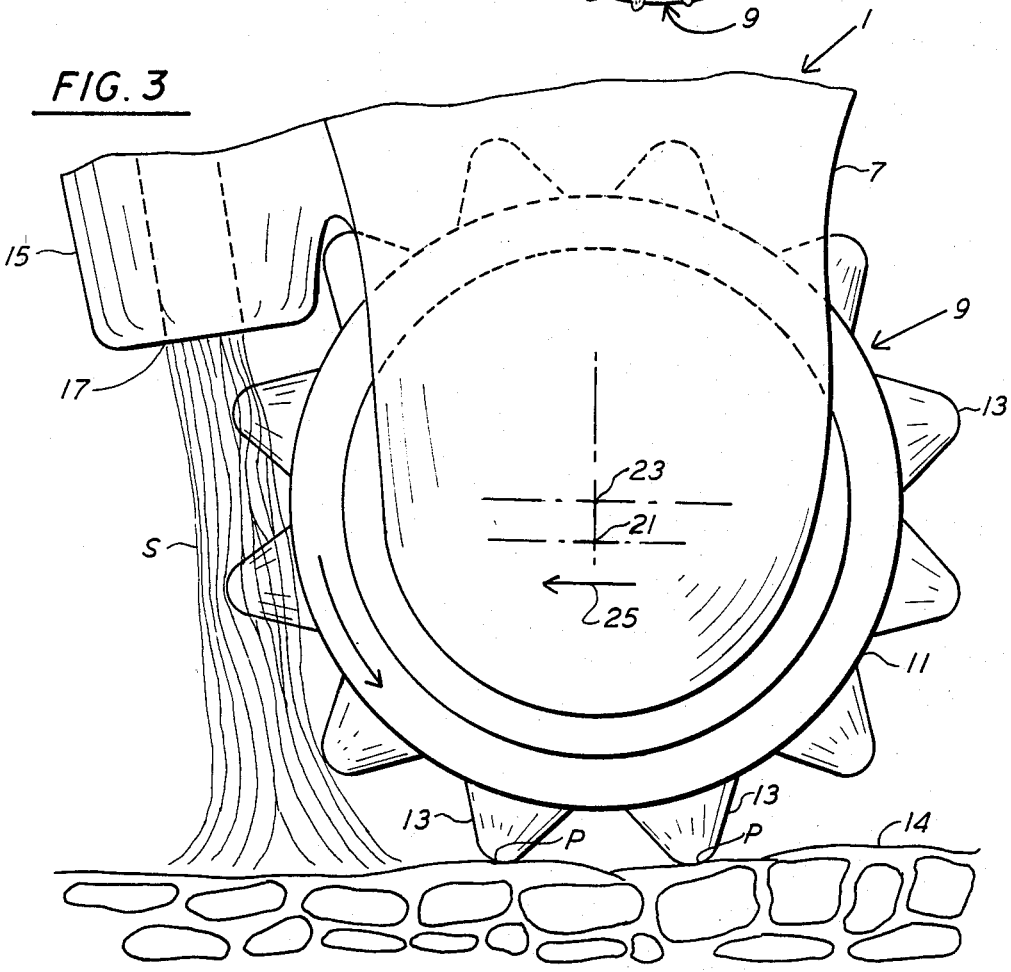
FIG. 3 is an enlarged partial side elevation of the drill bit on the bottom of a well bore showing a nozzle directing drilling fluid past an adjacent roller cutter and against the well bore bottom.

As shown in FIGS. 1–3, the drill bit further comprises three elongate nozzles 15 in the bit body having passaging in flow communication with the chamber in the bit body and opening to orifices 17 toward the bottom of the bit body 3. The nozzles extend down from the bit body generally between sets of adjacent pairs of roller cutters 9, and enable exit of the drilling fluid under pressure from the chamber. In accordance with this invention, these nozzle orifices 17 are positioned below the top of the adjacent roller cutters but above the inclined central axis of the adjacent bearing journal at both ends thereof (i.e., the centerline at the inner end of the bearing journal designated at 21 in FIG. 3 and the centerline at the outer end of the journal designated at 23). Being so positioned, the elongate nozzle 15 are well above damaged by irregularities, such as ridges or projections, on the bottom 14 as the bit rotates.

In addition, the nozzles 15 are so angled relative to the bit body 3 and roller cutters 9 that the nozzles direct the drilling fluid under pressure to exit downwardly and in the direction opposite to the direction of rotation of the bit, indicated by arrow 25 in FIG. 3. As best illustrated in FIG. 3, the fluid flows in a high velocity stream, designated S, angled relative to the longitudinal axis of the drill bit which is parallel to weld seam 27 generally toward the underside of the adjacent roller cutter (i.e., the half of the roller cutter below its longitudinal axis or axis of rotation) tangent to the cutter body 11 of the adjacent roller cutter, which is typically of steel alloy which has a relatively low resistance to erosion due to high velocity streams of drilling fluid. As the fluid flows past the cutters 9, it does, however impinge inserts 13 of the gage row of inserts and the row adjacent thereto. Being formed of tungsten carbide material having a high erosion resistance, the inserts, however, are not subject to significant erosion due to the stream of high velocity drilling fluid. While in FIG. 3 the stream is shown as being tangent to the cutter body (i.e., slightly engaging) it is contemplated that the stream may be spaced a short distance (e.g., one-quarter inch) from the body and extend along a line generally parallel to a tangent thereto.

After flowing past the roller cutter 9, the stream S of drilling fluid impinges portions of the bottom 14 of the well bore closely adjacent to, but spaced apart from (i.e., ahead or forward with respect to the direction of rotation 25 of the drill bit) all of the points, designated P in FIG. 3, of engagement of the inserts of the adjacent roller cutter with the bottom of the bore. These portions of the well bore are cleaned by the high velocity fluid, thereby exposing a virgin surface at the bottom 14 prior to its engagement by an insert 13.

Figure 5:
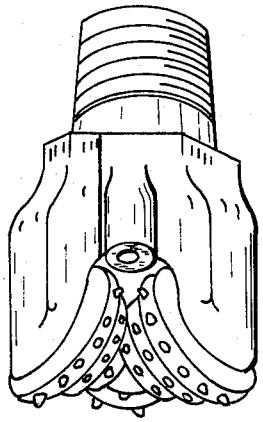
FIG. 5 PRIOR ART
FIG. 5 is a side elevation of a prior art drill bit.

It will be observed from the foregoing, that by so directing the stream S of drilling fluid both outer rows of inserts 13, as well as, portions of the well bore bottom 14 are cleaned by the drilling fluid immediately prior to the engagement of these portions of the well bore bottom by the inserts. Moreover as observed from FIG. 3, the passaging in the nozzles 15 directs the drilling fluid under pressure to flow in a stream 5 so angled and positioned relative to one of the roller cutters that as this roller cutter rotates cutting elements 13 thereon enter the stream for being cleaned thereby and then exit the stream prior to engaging the formation, with the stream after flowing past the cutting elements impinging the formation at the bottom of the well bore, whereby the formation and all of the cutting elements impinged by the stream are subjected to separate cleaning actions immediately prior to their engagement for presenting clean engagement surfaces to enhance the drill bit cutting action. These separate, sequential cutting actions have been found to result in enhanced drill bit cutting action and increased rates of penetration even in drilling relatively plastically deformable formations. Thus, the drill bit 1 of this invention represents an improvement over conventional drill bits of the type, such as shown in FIG. 5, in which the nozzles extend generally vertically and centrally down between adjacent roller cutters. Being so angled, these nozzles direct the drilling fluid so as not to impinge the roller cutter but, rather, only to impinge the formation at areas substantially forward of the roller cutter. The drill bit 1 also represents an improvement over drill bits of the type, such as shown in U.S. Pat. No. 4,106,577 and British Pat. No. 1,104,310, in which the nozzles direct the drilling fluid so as to simultaneously engage the cutting elements of the roller cutter and the bottom of the well bore (i.e., engage the cutting elements only at their points of engagement with formation).

In the manufacture of the first embodiment of the drill bit, the bit body 3 is formed from three so-called "lugs". Each lug is of one-piece forged construction, having an integrally formed bearing journal, leg 7, and elongate nozzle 15. The lugs are secured together in side-by-side relation as by welding along weld seams 27 to form a complete bit body.

Figure 4:
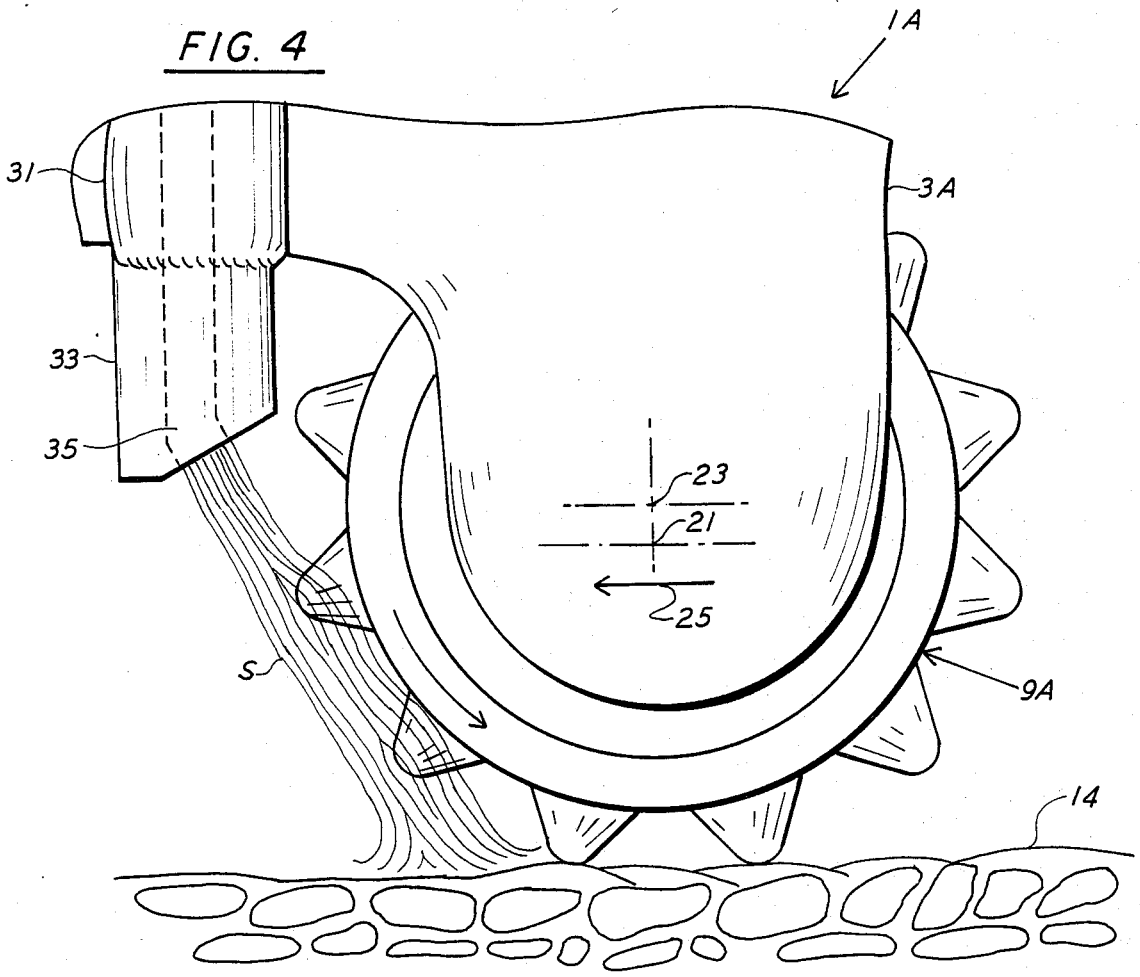
FIG. 4 is a view similar to FIG. 3 of a second embodiment of a drill bit of this invention.

FIG. 4 illustrates a second embodiment the drill bit of this invention generally indicated at 1A which is similar to the first embodiment 1 except that the bit body 3A is formed of conventional lugs having relatively short integrally formed nozzles 31. A tubular member 33 having passaging 35 therein, which at one end thereof is in alignment with that in the nozzle 31 and which at the other end thereof directs the fluid to flow tangent to an adjacent roller cutter 9A, is welded to the underside of the bit body 3A at each nozzle 31.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed:

1. A rotary drill bit for drilling a well bore, the bit comprising:

a bit body having a threaded pin at its upper end adapted to be detachably secured to drill pipe or the like for rotating the bit and delivering drilling fluid under pressure to the bit, a plurality of depending legs at its lower end, each leg being spaced from the other legs and having an inwardly and downwardly extending bearing journal at its lower end, and a plurality of nozzles for exit of the drilling fluid from the bit body; and a plurality of roller cutters, one for each leg, each roller cutter comprising a generally conical cutter body rotatably mounted on the bearing journal of the respective leg and a plurality of cutting elements on the body;

each of said nozzles having a nozzle orifice below the top of an adjacent roller cutter but above the central axis of the respective bearing journal at its outer end with respect to the bit body, each nozzle directing the drilling fluid to flow downwardly in a stream flowing past the cutter body of the adjacent roller cutter along a line generally tangent thereto and thereafter impinging portions of the bottom of the well bore forward, with respect to the direction of rotation of the bit, of all points at which the cutting elements of the adjacent roller cutter then engages the bottom of the bore, whereby the drilling fluid sequentially impinges and cleans cutting elements on the adjacent roller cutter and then the well bore bottom immediately prior to the engagement of said portions of the well bore bottom by the cutting elements for enhanced drill bit cutting action.

2. A drill bit as set forth in claim 1 wherein said cutting elements are generally elongate members of tungsten carbide material and are mounted on the roller cutter body with a portion thereof projecting outwardly beyond the generally conical surface of the roller cutter body.

3. A drill bit as set forth in claim 1 wherein the cutting elements of each roller cutter are arranged in annular rows around the cutter body, the stream of drilling fluid from each nozzle impinging cutting elements of at least one of the outer rows of cutting elements of the respective roller cutter.

4. A drill bit as set forth in claim 1 wherein each nozzle comprises a tubular member depending from the underside of the bit body.

5. A drill bit as set forth in claim 4 wherein said legs are spaced at equal intervals around the periphery of the bit body, and one of said nozzles extends down between each pair of adjacent legs.

6. A drill bit as set forth in claim 5 wherein the bit body further comprises a plurality of lugs, each of one-piece construction, having one of said legs and one of said nozzles integrally formed therein, the lugs being secured together in side-by-side relation to form the bit body.

7. A drill bit as set forth in claim 6 wherein the nozzle is a generally tubular member formed on the side of the bit body, the tubular member extending down and in the direction opposite the direction of rotation of the bit.

8. A rotary drill bit for drilling a well bore, the bit comprising:

a bit body having a threaded pin at its upper end adapted to be detachably secured to drill pipe or the like for rotating the bit and delivering drilling fluid under pressure to the bit, a plurality of depending legs at its lower end, each leg being spaced from the other legs and having a bearing journal at its lower end, and a plurality of nozzles, one for each of said legs, for exit of the drilling fluid from the bit body; and a plurality of roller cutters, one for each leg, each roller cutter comprising a generally conical cutter body rotatably mounted on the bearing journal of the respective leg and a plurality of cutting elements on the body;

each of said nozzles having a nozzle orifice positioned above the central axis of the respective bearing journal at its inner end with respect to the bit body, each nozzle having passaging therein directing the drilling fluid to flow downwardly in a stream angled relative to the longitudinal axis of the drill bit and flowing generally toward the underside of an adjacent roller cutter, constituted by the half of said roller cutter below its axis of rotation, along a line generally tangent to the cutter body and thereafter impinging portions of the bottom of the well bore forward, with respect to the direction of the rotation of the bit, of all points at which the cutting elements of the adjacent roller cutter then engage the bottom of the bore, whereby the drilling fluid sequentially impinges and cleans cutting elements on the adjacent roller cutter and then the well bore bottom immediately prior to the engagement of said portions of the well bore bottom by the cutting elements for enhanced drill bit cutting action.

9. A rotary drill bit for drilling a well bore, the bit comprising:

a bit body adapted to be detachably secured to drill pipe or the like for rotating the bit and to receive drilling fluid under pressure from the drill pipe, the bit body having a plurality of spaced apart, depending legs at its lower end, and a plurality of nozzles, one for each of said legs, for exit of the drilling fluid from the bit body; and a plurality of roller cutters, one for each of said legs, rotatably secured to the legs at the lower end thereof, each roller cutter comprising a generally frusto-conical cutter body and a plurality of hard metallic cutting elements secured to the cutter body;

each of said nozzles having passaging therein directing the drilling fluid under pressure to flow downwardly in a stream angled relative to the longitudinal axis of the drill bit and generally toward the underside of one of said roller cutters, constituted by the half of said one roller cutter below its axis of rotation, along a line generally adjacent to its cutter body, the drilling fluid impinging at least some of the cutting elements on the roller cutter and thereafter impinging the formation generally at the bottom of the well bore, whereby the formation and all cutting elements impinged by the stream are subjected to separate, sequential cleaning actions immediately prior to their engagement for presenting clean engagement surfaces to enhance the drill bit cutting action.

10. A rotary drill bit as set forth in claim 9 wherein the stream of drilling fluid from each nozzle flows along a line generally tangent to the cutter body of the respective roller cutter.

11. A rotary drill bit as set forth in claim 9 wherein the stream of drilling fluid from each nozzle flows in a direction generally opposite to the direction of rotation of the drill bit.

12. A rotary drill bit as set forth in claim 9 wherein the stream of drilling fluid from each nozzle impinges portions of the formation at the bottom of the well bore closely adjacent to, but spaced apart from the points of engagement of the cutting elements of the roller cutter with the formation.

13. A rotary drill bit as set forth in claim 9 wherein the cutting elements of each roller cutter are arranged in annular rows around the cutter body, the stream of drilling fluid from each nozzle impinging cutting elements of at least one of the outer rows of cutting elements of the respective roller cutter.

14. A rotary drill bit for drilling a well bore, the bit comprising:

a bit body adapted to be detachably secured to drill pipe or the like for rotating the bit and to receive drilling fluid under pressure from the drill pipe, the bit body having a plurality of spaced apart, depending legs at its lower end, and a plurality of nozzles, one for each of said legs for exit of the drilling fluid from the bit body; and a plurality of roller cutters, one for each of said legs, rotatably secured to the legs at the lower end thereof, each roller cutter comprising a generally frusto-conical cutter body and a plurality of hard metallic cutting elements on the cutter body;

each of said nozzles having passaging therein directing the drilling fluid under pressure to flow downwardly in a stream angled relative to the longitudinal axis of the drill bit and generally toward the underside of one of said roller cutters, constituted by the half of said one roller cutter below its axis of rotation, with the stream being so angled and positioned relative to said one roller cutter that as said one roller cutter rotates cutting elements thereon enter the stream for being cleaned thereby and then exit the stream prior to engaging the formation at the bottom of the well bore, with the stream after flowing past the cutting elements impinging the formation at the well bore bottom, whereby the formation and the cutting elements impinged by the stream are subjected to separate, sequential cleaning actions immediately prior to their engagement for presenting clean engagement surfaces to enhance the drill bit cutting action.

* * * * *